US006075497A

United States Patent [19]

Chen et al.

[11] Patent Number: 6,075,497

[45] Date of Patent: Jun. 13, 2000

[54] MULTIPLE-FEED ELECTROMAGNETIC SIGNAL RECEIVING APPARATUS

[75] Inventors: Michael Chen; Jiahn-Rong Gau, both of Taiwan, Taiwan

[73] Assignee: Acer Neweb Corp., Hsinchu, Taiwan

[21] Appl. No.: 08/885,185

[22] Filed: Jun. 30, 1997

[51] Int. Cl.[7] ..... H01Q 19/12

[52] U.S. Cl. ..... 343/840; 343/776; 343/785; 343/786

[58] Field of Search ..... 343/840, 785, 343/753, 754, 786, 909, 756, 725, 780, 776

[56] References Cited

U.S. PATENT DOCUMENTS

| | | | |
|---|---|---|---|
| 2,989,747 | 6/1961 | Atchison | 343/776 |
| 2,997,711 | 8/1961 | Love | 343/776 |
| 3,568,204 | 3/1971 | Blaisdell | 343/725 |
| 3,858,214 | 12/1974 | Jones, Jr. | 343/785 |
| 4,318,103 | 3/1982 | Roettele et al. | 343/753 |
| 4,329,692 | 5/1982 | Brunner | 343/780 |
| 4,498,061 | 2/1985 | Morz et al. | 333/21 A |
| 5,245,353 | 9/1993 | Gould | 343/786 |
| 5,550,553 | 8/1996 | Yamaki et al. | 343/785 |
| 5,630,226 | 5/1997 | Kanda et al. | 343/756 |
| 5,642,121 | 6/1997 | Martek et al. | 343/786 |
| 5,757,323 | 5/1998 | Spencer | 343/785 |
| 5,786,763 | 7/1998 | Canipe | 343/876 |
| 5,796,371 | 8/1998 | Sato et al. | 343/786 |
| 5,812,096 | 9/1998 | Tilford | 343/840 |

FOREIGN PATENT DOCUMENTS

| | | | |
|---|---|---|---|
| 406069722 | 3/1994 | Japan | H01Q 19/17 |

*Primary Examiner*—Don Wong
*Assistant Examiner*—Hoang Nguyen
*Attorney, Agent, or Firm*—Robert H. Chen

[57] ABSTRACT

This invention discloses a novel design for receiving electromagnetic signals broadcasted from at least two of satellite clusters and collected by a single dish antenna. At least two signal feeds are used to feed the signals to a processing circuit. The processing circuit performs signal selection, amplification, and frequency conversion. Corrective lens are used to ensure uniform wavefront of the electromagnetic signals received by the signal feeds located farther away from the focal point of the dish antenna. A convenient adjustment device is provided for adjustment of the relative positions of the signals feeds to the dish antenna.

22 Claims, 7 Drawing Sheets

MULTIPLE-FEED ELECTROMAGNETIC SIGNAL RECEIVING APPARATUS

BACKGROUND OF THE INVENTION

1. Field of the Invention

This invention relates generally to electromagnetic signal receiving devices, and more particularly to a receiving antenna with a plurality of feeds for receiving microwave signals emanating from more than one direction.

2. Description of the Prior Art

Direct Broadcast Satellite (DBS) is a point-tom-ultipoint system in which individual households equipped with a small receiving antenna and tuner device receive broadcasts directly from a geostationary satellite. The satellite receives digital audio and video transmissions from ground stations and relays them directly to individuals. The receiving antenna is comprised of a parabolic dish designed to collimate the satellite signals at the focal point, where an LNBF (Low Noise Block with integrated Feed) module is mounted to convert the incoming signals to a lower frequency band and transmit it to a tuner device. The LNBF module also acts as a filter and an amplifier to selectively boost the signal received by the dish collector. The LNBF module comprises a feed for receiving microwaves and circuitry for processing the received microwaves.

Because of the high sensitivity of these devices and relatively high satellite transmitting power, the parabolic dish collector currently being used can be as small as 0.4 meter in diameter. The dishes are mounted outside the home and are manually aligned with a diagnostic display showing received signal strength. Inside the home, a phase-lock loop tuner demodulates the signal from the LNBF module into video and audio signals suitable for a television or stereo tuner.

Normally, each satellite dish antenna is aligned to receive signals from a particular cluster (or group) of satellites in a certain direction. To a dish antenna on earth, the satellites belonging to the same cluster are located so close together that their signals are indistinguishable from signals emanating from a single satellite. Microwave signals aligned to the axis of the parabolic antenna dish are collected at the focal point, where the LNBF module is located. Shown in FIG. 1 is a typical LNBF module. Much effort has been put into the design of the feed structure to increase dish gain, polarization isolation, and selectivity. Much research has also been done to find ways to increase bandwidth during transmission using modulation techniques, or using different polarization methods to transmit different channels of signals. When receiving signals from different satellite clusters, more than one dish antenna may be used to point to the different angles. Another method is to use an electric motor to turn the antenna assembly to point to different satellites. However, employing these methods would make the antenna too expensive for general home use.

When two satellites (or two clusters of satellites), are separated by a small angle (the angle being larger than the separation angle between satellites within the same cluster), it is possible to use two LNBF modules placed side by side near the focal point to receive signals from the two satellites. The separation between the feeds of the two LNBF modules is proportional to the separation angles of the two satellites and the focal length. With an F/D (dish focal length over dish diameter) ratio fixed, as the dish size is decreased to less than half a meter, it becomes very difficult to place two conventional horn feeds within the required distance without causing excessive spill over loss. The spill over loss will show up as a signal to noise ratio decrease which will affect signal reception quality.

To effectively match the LNBF feed to the dish antenna, the feed radiation pattern should have a gain drop of about −10 to −12 dB for signals coming from outside the dish boundary. The radiation field pattern of a horn feed is correlated with the width of the horn opening. The wider the opening is, the narrower the radiation field pattern will become. Narrower feed radiation pattern can better filter out unwanted signals and decrease spill over loss. It can also lessen the demand for a high antenna dish directivity.

Typically, for a dish collector receiving signals ranging from 12.2–12.7 GHz, having a 45 centimeter diameter, and a focal length of 20 centimeters, the optimized opening of the horn feed should be around 3.6 cm. If the opening is too narrow, then too much noise will be picked up by the horn feed, increasing the spill over noise. When the two satellites are separated by 4.5 degrees, for example, the separation between the opening centers of the two horn feeds should be about 2.35 cm. To reduce the spill over loss, a much wider antenna dish would be required for receiving signals from two satellite systems than that of receiving signals from a single satellite system.

SUMMARY OF THE INVENTION

What is needed, therefore, is a compact signal receiving apparatus having a plurality of feeds for receiving signals from a plurality of satellite clusters.

The present invention is a signal receiving apparatus comprising an antenna for collecting signals transmitted from at least two sources, a predetermined configuration of at least two signal feeds coupled to the antenna, wherein the predetermined configuration is determined by the relative positions of the signal sources. The preferred embodiment includes signal feeds composed of dielectric rod feeds and a horn feed, corrective lens for adjusting the amplitude and phase of signals collected bad the antenna, and a processing circuit.

One advantage of the present invention is to provide a compact and cost effective multiple-feed signal receiver for use in conjunction with a parabolic dish antenna to receive signals from more than one satellite clusters.

Another advantage is that the feed position and polarization angle adjustment of the multiple feeds of the signal receiver is greatly simplified. By using the adjustment mechanism disclosed in this invention, the multiple feeds can be adjusted simultaneously in a simple manner.

Other features, advantages and embodiments of the invention will be apparent to those skilled in the art from the following description, accompanying drawings and appended claims.

DESCRIPTION OF THE INVENTION

The present invention is a multi-feed signal receiver for receiving signals from two satellites (or two satellite clusters). The signal receiver comprises signal feeds for feeding signals to a circuit module for processing of the signals. For clarity of description, an LNBF (Low Noise Block with integrated Feed) is used as an illustration of an embodiment. The term LNBF is used for purposes of illustration only, and does not limit the scope of the present invention.

In the following description, for simplicity, whenever convenient, similar components will have the same numbering labels regardless of embodiment.

Figure 2:
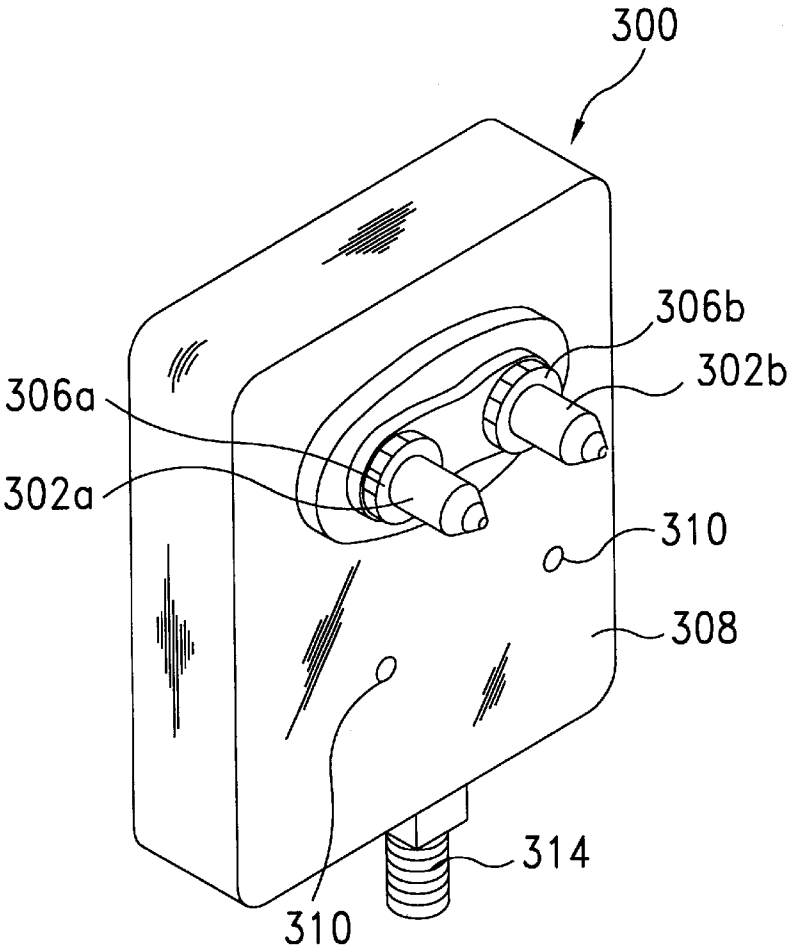
FIG. 2 is a drawing of a twin feed LNBF module with two dielectric rod feeds.
Figure 1:
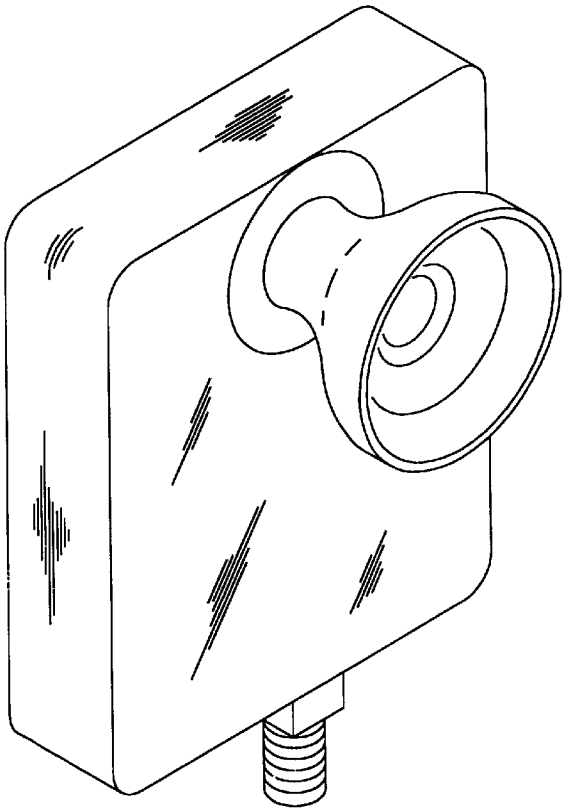
FIG. 1 (PRIOR ART)
FIG. 1 is a diagram drawing showing a prior art LNBF module used in a satellite receiver system utilizing a horn feed.

As shown in FIG. 2, a twin rod LNBF 300 comprises an outer housing 308, two chokes 306*a* and 306*b*, two rod feeds 302*a* and 302*b*, and a coupling port 314 for coupling output signals to a tuner device (not shown in the figure). The two chokes 306*a*, 306*b* are attached to the housing 308, and the two rod feeds 302*a* and 302*b* protrude from the two chokes 306*a* and 306*b*.

The protruding rods having a smaller cross section provides the same directivity as a horn feed of a greater cross section. The longer the rod, the higher the directivity of the radiation/receiving pattern, and the higher the S/N ratio. Screws 310 are provided to secure the twin rod LNBF 300 to a LNBF holder 606. A dielectric cover 418 is used for protecting the rod feeds 302*a* and 302*b* from dust and rain.

Figure 3:
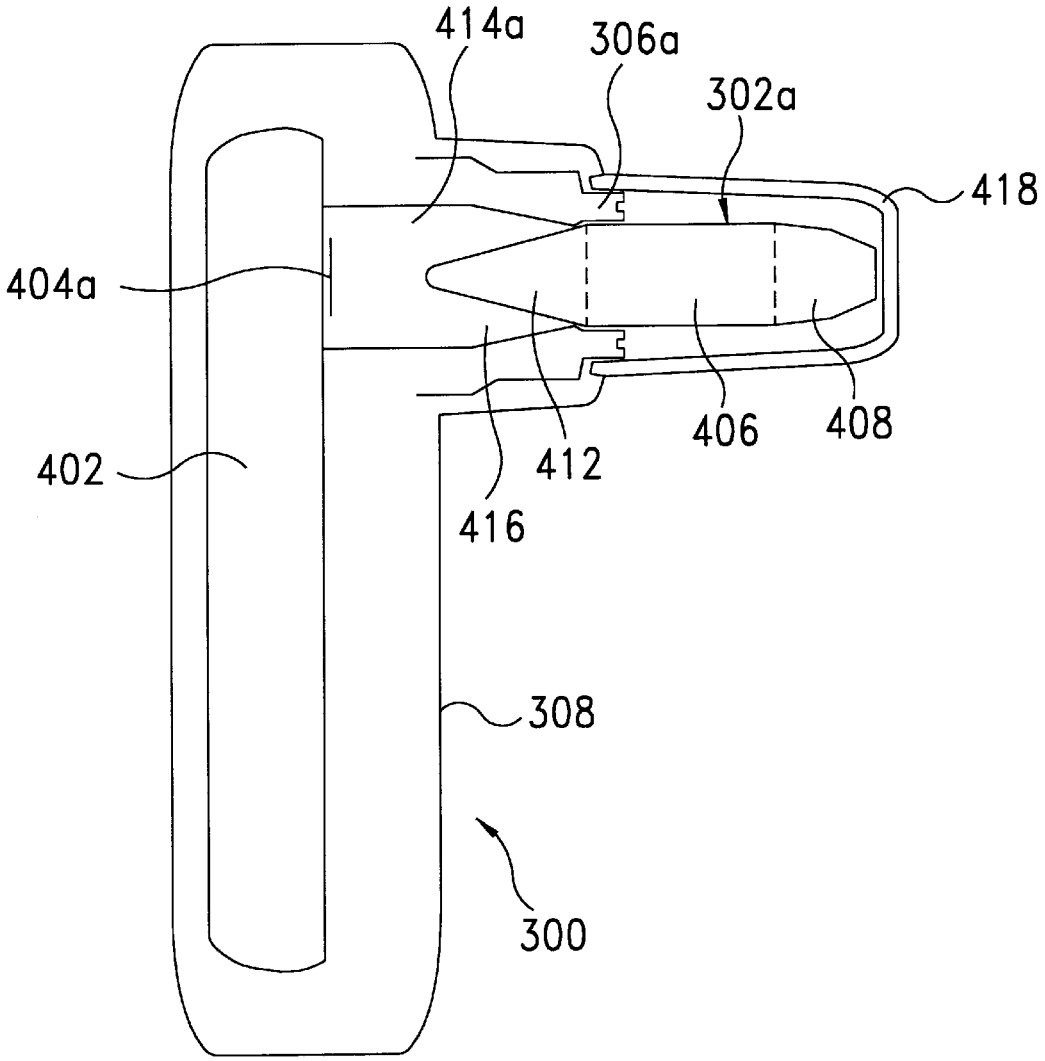
FIG. 3 is a side view of the twin feed LNBF module.

FIG. 3 shows a sectional side view of the twin rod LNBF 300. Two waveguides 414*a* and 414*b* (not shown) are located inside the outer housing 308. One end of the waveguide 414*a*, via a waveguide taper section 416, is coupled to the rod feed 302*a*. A pair of probe pins 404*a* are located at the other end of the waveguide 414*a* for receiving the microwave signals in the waveguide 414*a* and transmitting it to a circuit module 402. The rod feed 302*a* comprises a cylindrical middle section 406, a compressed frustum section 408, and a elongated frustum section 412. Rod feed 302*b* is similarly shaped.

With appropriate rod end shaping, the sidelobe level of the feed radiation/reception pattern can be suppressed. The elongated frustum section 412, combined with the waveguide taper 416, forms a taper transition to provide an impedance matching bridge between conventional waveguide probe pin structure and the smaller sized rod feed. The pair of probe pins 404*a* receives the signals in the waveguide 414*a* and transmit it to a circuit module 402 for processing of the received microwave signals.

A dielectric cover 418 (preferably made of AES material, a material which is similar to ABS plastic but has better erosion resistance) is used to protect the rod feeds from dust and rain. Guard rings are provided around the chokes 306*a* and 306*b* for securing the dielectric cover 418. The shape and geometry of the dielectric cover 418 is appropriately tuned so as to act as an external rod antenna to assist the rod feeds 302*a* and 302*b* for achieving higher directivity.

With the aid of the dielectric cover 418, the rod length of the rod feeds 302*a* and 302*b* can be reduced while still conforming to a required directivity. A shorter rod feed used in conjunction with the dielectric cover 418 has substantially the same gain as a longer rod feed without the dielectric cover 418. In comparison, adding a dielectric cover to a horn feed does not increase its directivity.

Figure 4:
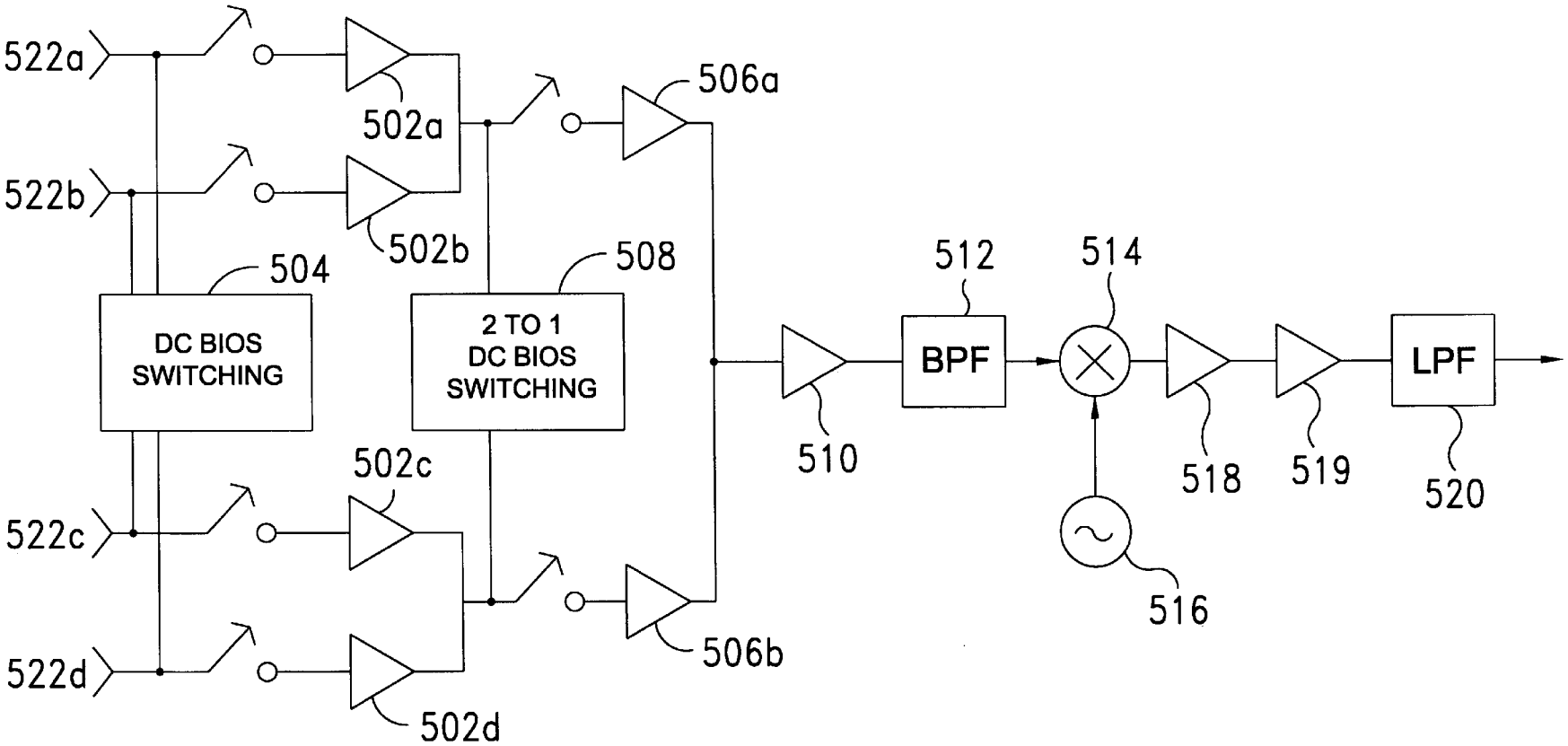
FIG. 4 is a block diagram of the circuit module in the twin feed LNBF module.

FIG. 4 shows a block diagram of the circuit module 402. The set of probe pins 404*a* comprises two orthogonally placed probe pins 522*a* and 522*b* for receiving linearly polarized waves. Microwave signals polarized in the horizontal and vertical direction with the same frequency can be used to transmit two channels of signals. The probe pins 522*a* and 522*b* are coupled to two low noise amplifiers 502*a* and 502*b* via a first switching circuitry 504, preferably two MOSFET transmission gates. Similarly, the set of probe pins 404*b*, comprising a pair of probe pins 522*c* and 522*d*, are coupled to a pair of low noise amplifiers 502*c* and 502*d* via the first switching circuitry 504.

Through the switching circuitry 504, only one of the signals from the four probe pins 522*a–d* is transmitted to the first stage low noise amplifier. In order to achieve sufficient gain to amplify the weak satellite signals, second stage amplifiers 506*a* and 506*b* are used. The signals from amplifiers 502*a–d* are transmitted to the second stage amplifiers 506*a* and 506*b* via a second switching circuitry 508. For the purpose of increasing isolation, those amplifiers 502*a–d* and 506*a–b* are turned off when not in use.

The output from the second stage amplifiers 506*a–b* are further amplified by a third stage amplifier 510. The output of the third stage amplifier 510 is transmitted to a band pass filter 512, thereby producing a filtered signal. The filtered signal is then transmitted to a mixer 514 which combines the filtered signal with a modulation signal from a local oscillator 516, thereby producing a higher and a lower frequency filtered signals. The higher and the lower frequency filtered signals are transmitted to intermediate frequency (IF) amplifiers 518 and 519, and are then transmitted to a low pass filter 520 to filter out the unwanted higher frequency filtered signal. The output from the low pass filter 520 is then transmitted to the coupling port 314 for coupling to a tuner device (not shown in FIG. 4).

Figure 5:
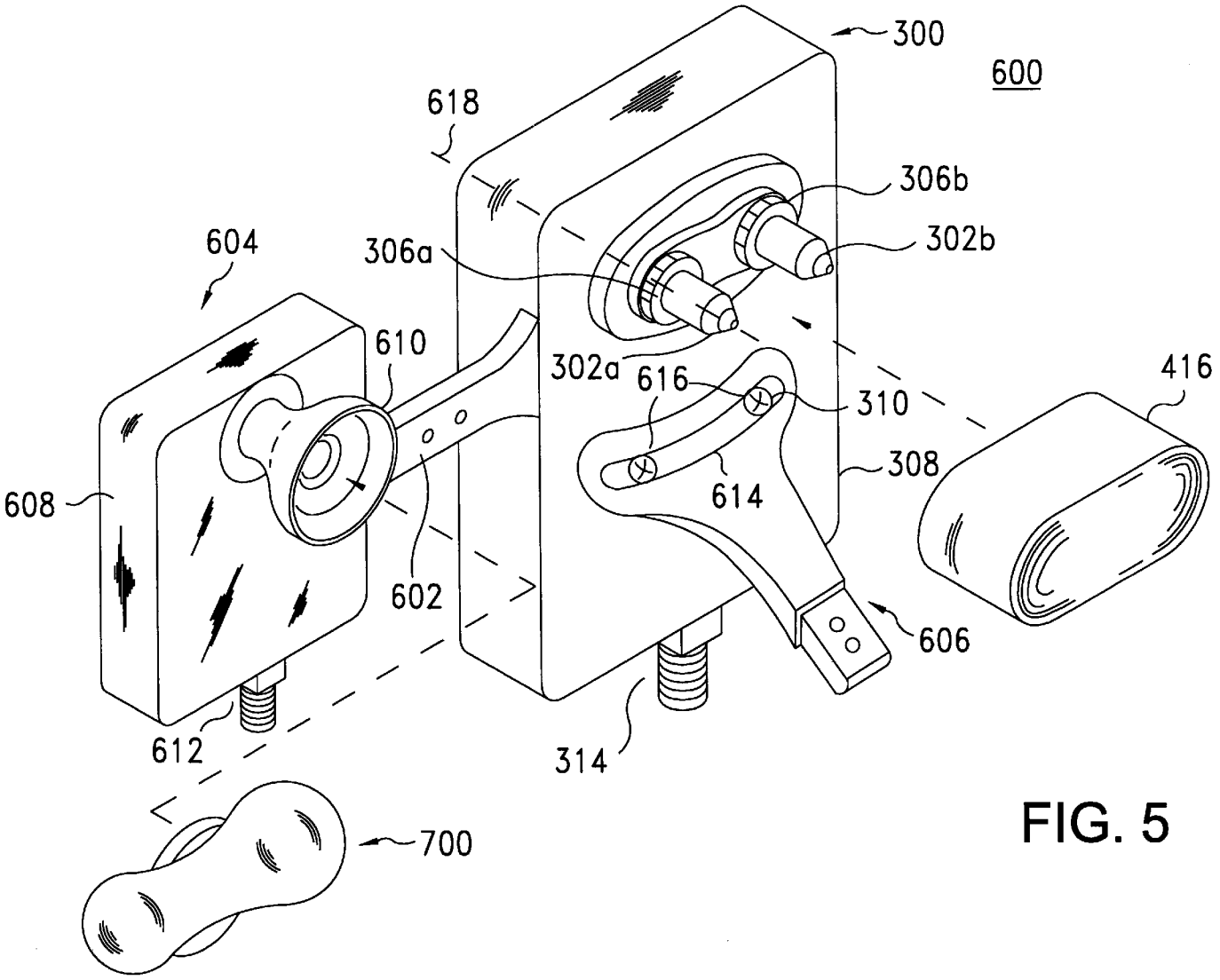
FIG. 5 shows the preferred embodiment of the present invention with a triple feed LNBF module.

FIG. 5 is a preferred embodiment of the present invention used for receiving signals from three satellites. A triple feed LNBF module 600 comprises a twin rod module 300, a connection bridge 602, a horn feed module 604, and an LNBF holder 606. The horn feed module 604 comprises a horn feed housing 608, a horn feed 610, a phase corrective lens 700, and a horn feed output port 612.

Figure 8:
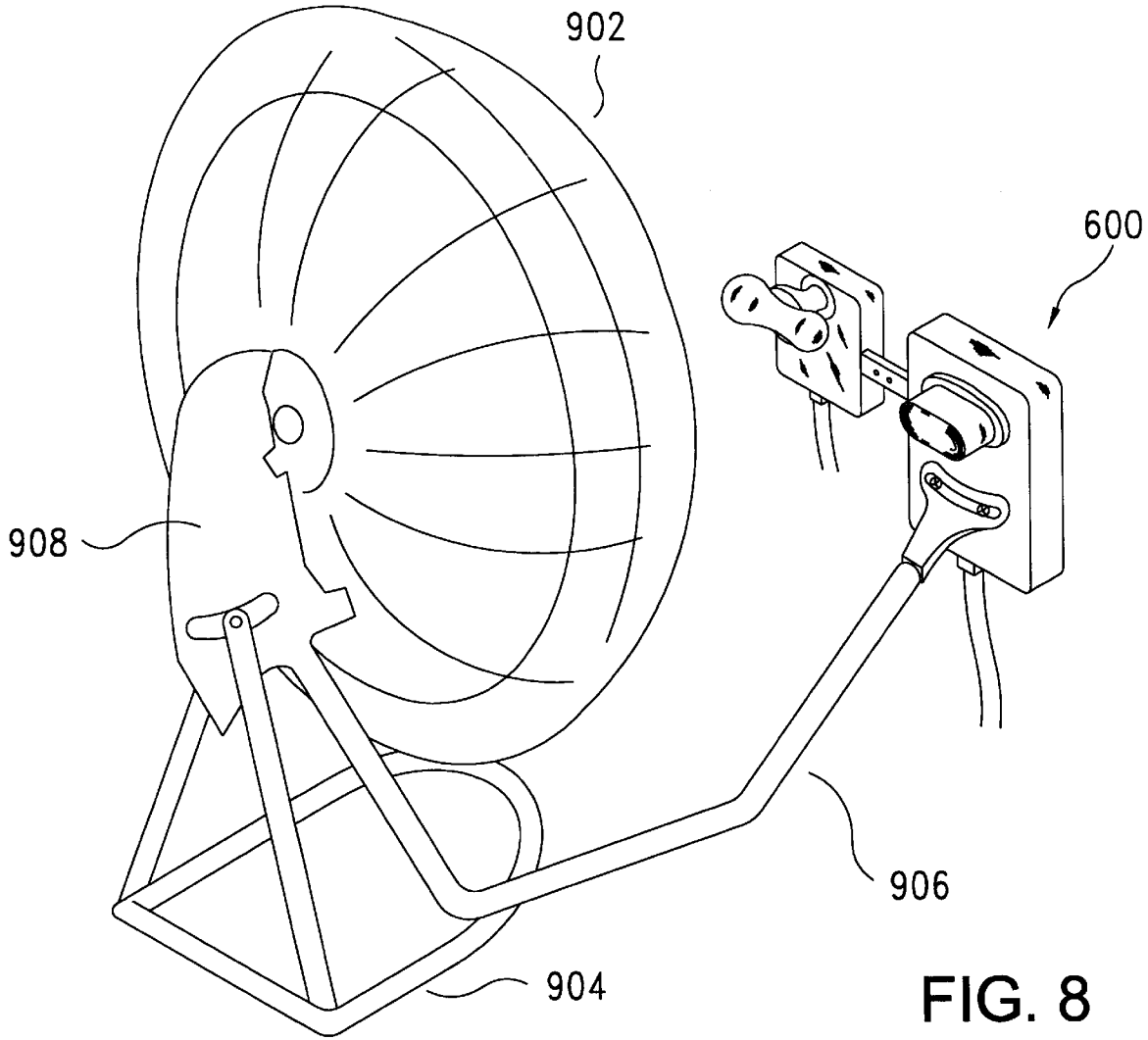
FIG. 8 shows an operational diagram of the present invention with an dish antenna and a triple feed LNBF module.

The horn feed 610 is placed at a position where the signals from the third satellite is reflected and collected by a parabolic dish antenna 902 (shown in FIG. 8). However, because the horn feed 610 is at a distance from the focal point of the dish antenna 902, the microwaves received by the horn feed suffer severe distortion. This may cause severe errors in the received signals obtained by the horn feed 610. A phase and amplitude corrective lens is needed to correct the distorted phase waveform.

Figure 6A:
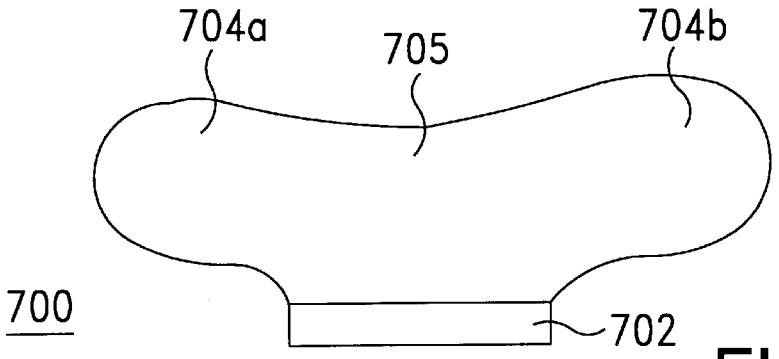
FIGS. 6 (a)–(c) are drawings of a microwave corrective lens.
Figure 6B:
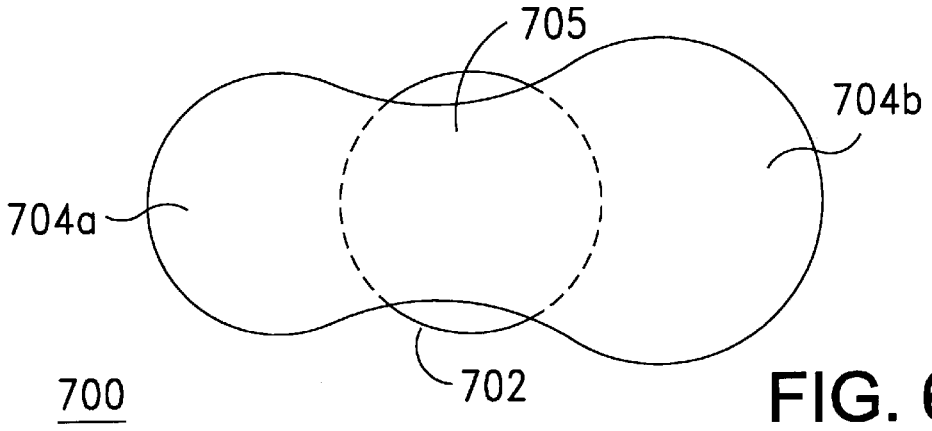

FIGS. 6*a* and 6*b* show the side view and top view of a corrective lens 700 which has an ellipsoidal cylindrical center section 705 and a first half-prolated ellipsoidal lobe 704*a* and a second half-prolated ellipsoidal lobe 704*b* (squash-shaped).

Figure 6C:
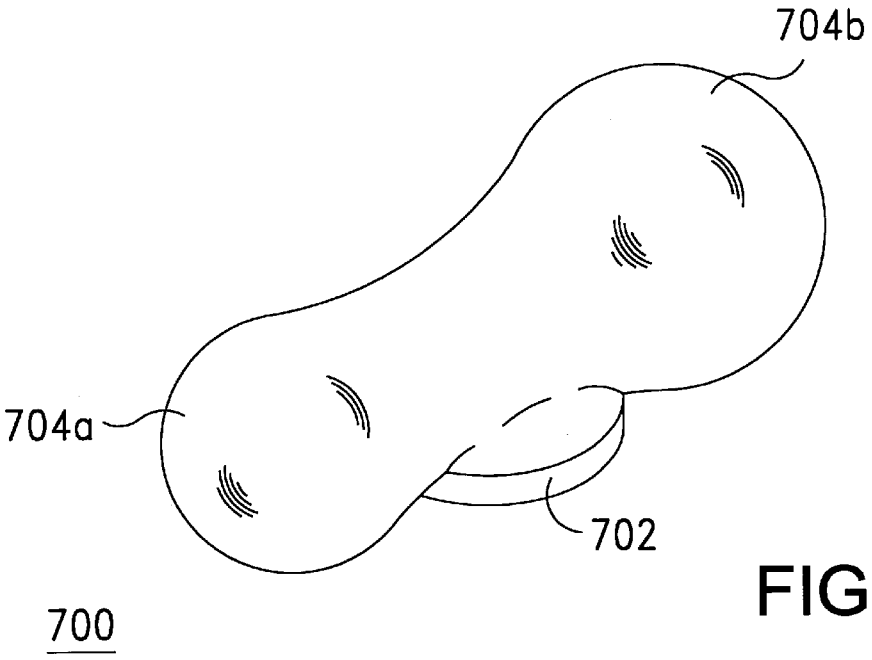

FIG. 6*c* is a mesh wire drawing of the corrective lens 700. The corrective lens 700 comprises a mount 702 to fit around the outer rim of the horn feed 610, the first lobe 704*a* and the second lobe 704*b* for restoring the correct phase pattern. The second lobe 704*b* has a longer shape than the first lobe 704*a*. When mounted on the outer rim of the horn feeder 610, the second lobe 704*b* is placed closer to the focal point of the dish antenna 902 than the second lobe 704*a*.

Figure 7A:
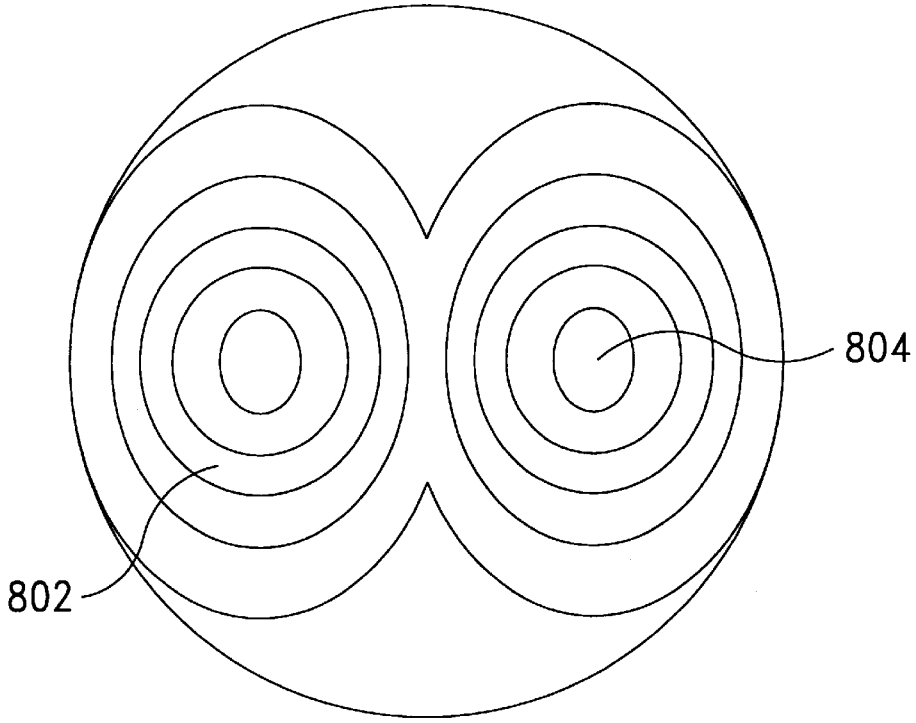
FIGS. 7 (a)–(b) are phase contour maps of microwaves before and after phase correction by the microwave corrective lens.
Figure 7B:
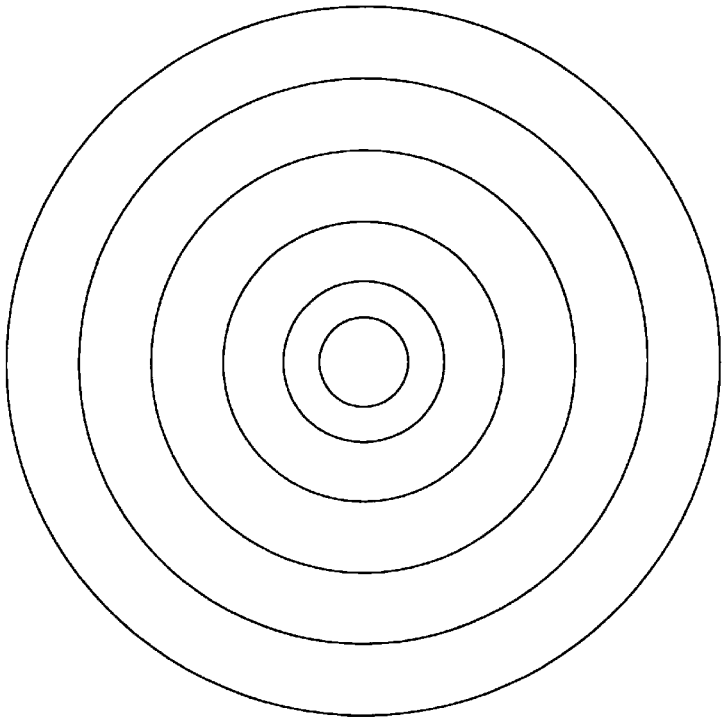

FIG. 7*a* shows a phase contour map of a microwave signal received by the horn feed 610 which is located at a distance from the focal point of the dish antenna 902. The constant phase contour lines form two concentric regions 802 and 804. FIG. 7*b* shows the contour lines when the corrective lens 702 is mounted on the horn feed 610. The contour lines form one concentric region, resembling that of an ideal microwave signal phase contour map. The corrective lens 702 is shaped so that not only the phase of the microwaves is adjusted, the amplitude is also adjusted so that a microwave signal reaching the horn feed with have a amplitude plane resembling that of an ideal microwave signal.

Again referring to FIG. 5, the LNBF holder 606 has an arc-shaped aperture 614 disposed therein. An axis 618 runs through the center of the rod feed 302*a*. The arc-shaped aperture 614 conforms to an outer rim of an imaginary circle with axis 618 as center axis, and having a radius equal to the distance between screws 616 to the axis 618. The triple feed LNBF module 600 is fastened to the feed holder 606 via the screws 616 running through the arc-shaped aperture 614. The screws 616 are fastened to screw holes 310 on the housing 308. By adjusting the relative positions of the twin feed module 300 to the LNBF holder 606, the relative angles of the three feeds to the dish antenna 902 can be changed.

FIG. 8 is an operational view of the triple feed LNBF module 600. The triple feed LNBF module 600 is fastened to an extending arm 906, where the extending arm 906 is connected to a dish mounting bracket 908, which is in turn secured to the parabolic dish antenna 902. The dish mounting bracket 908 is connected to a base 904. When adjusting the triple feed LNBF module 600, the relative position of the center feed, namely the rod feed 302*a*, to the parabolic dish antenna 902 is not changed, and is always located at the focus of the dish antenna 902. The triple feed LNBF module 600 rotates with the axis 618 as the center axis.

When tuning the triple feed LNBF module 600 to the corresponding directions of the three satellites, the first step is to adjust the dish antenna 902 so that the rod feed 302*a* is tuned to its corresponding satellite. The second step is to adjust the other two feeds by changing the relative positions of the triple feed LNBF module 600 to the LNBF holder 606 until the other two feeds are also tuned to their corresponding satellites. Preferably, markings on the outer housing 308 and on the LNBF holder 606 show their relative angles. A table can be used to list the angular adjustment required for a number of predetermined geographical regions, for example;, Washington D.C. and Los Angeles.

The feeds must each be pointing to its corresponding satellite (or satellite cluster) and yet located at the position where the signals are best collimated by the dish antenna. Also, for linear polarization satellite communication systems, the antenna feeds need to be rotated about their axes, so that the direction of the energy collecting probe pins can match the incoming wave polarizations. These parameters vary considerably for different geographical regions because the relative positions of the satellites as seen on the ground, and their respective signal polarization angles, will change from location to location. The adjustment mechanism described in this invention provides simultaneous adjustment of the multiple feeds in a simple manner.

While the above is a full description of the specific embodiments, various modifications, alternative constructions and equivalents may be used. For example, the number of dielectric rod feeds can be changed according to practical considerations. The shape of the corrective lens can also be altered according to feed positions and different dish antenna shapes and dimensions. The circuit module can be modified to provide different functions.

Therefore, the above description and illustrations should not be taken as limiting the scope of the present invention which is defined by the following claims.

What is claimed is:

1. A signal receiving apparatus comprising:

antenna means for collecting signals transmitted from at least two sources;

a plurality of waveguides, each having a tapered end portion;

a plurality of rod feeds for collecting the signals, each rod feed having an elongated frustum end portion, said elongated frustum end portion of each said rod feed being functionally coupled to said tapered end portion of each said waveguide for impedance-matching each said waveguide;

a predetermined configuration of said rod feeds coupled to said antenna means, wherein said predetermined configuration is determined by the relative positions of the signal sources; and at least one horn feed having a predetermined relative configuration with said rod feeds, said at least one horn feed being coupled to said antenna means, wherein said predetermined relative configuration is determined by the relative positions of the signal sources.

2. The signal receiving apparatus of claim 1, further comprising a corrective lens disposed on said at least one horn feed, said corrective lens including:

a phase delay module coupled to the antenna feed for reshaping the wavefront of the signals collected by said antenna means prior to the signals entering the antenna feed thereby smoothing the signals, said phase delay module having an ellipsoidal cylindrical center section, a first half-prolated ellipsoidal lobe and a second half-prolated ellipsoidal lobe.

3. The signal receiving apparatus of claim 1, further comprising circuit means for amplifying the signals collected by said antenna means.

4. The signal receiving apparatus of claim 3, said circuit means further comprise selection circuitry for selection between the signals from said at least two sources.

5. The signal receiving apparatus of claim 4, wherein said selection circuitry comprises at least two MOSFET transmission gates.

6. The signal receiving apparatus of claim 3, said circuit means further comprise converting circuitry for converting the frequency of the signals.

7. The signal receiving apparatus of claim 3, further comprising:

a probe pin, functionally coupled to one of said waveguides and to said circuit means, wherein the signals collected by said antenna means are transmitted via said feed, said waveguide, and said probe pin to said circuit means.

8. The signal receiving apparatus of claim 3, further comprising:

a set of orthogonal probe pins, functionally coupled to one of said waveguidea and to said circuit means, for receiving orthogonally polarized signals transmitted in said waveguide, whereby said orthogonally polarized signals are transmitted via said feed, said waveguide, and said probe pins to said circuit means.

9. The signal receiving apparatus of claim 1, further comprising a dielectric cover disposed above said rod feeds for covering said rod feeds and for enhancing the gain of said rod feeds.

10. The signal receiving apparatus of claim 1, wherein each said rod feed further comprises a cylindrical middle section, and a compressed frustum.

11. A signal receiving apparatus comprising:

antenna means for collecting signals transmitted from at least two sources;

a plurality of waveguides;

a plurality of rod feeds for collecting the signals, each said rod feed being functionally coupled to each said;

a horn feed; and a predetermined configuration of said rod feeds and said horn feed coupled to said antenna means, wherein said predetermined configuration is determined by the relative positions of the signal sources.

12. The signal receiving apparatus of claim 11, wherein said sources are at least two clusters of satellites, each cluster of satellites comprising at least one satellite.

13. The signal receiving apparatus of claim 11, wherein said antenna means comprises a dish antenna.

14. A signal receiving apparatus for receiving signals transmitted from at least two sources, and collected by a single antenna, comprising:

a housing having a plurality of chokes disposed thereon and a plurality of waveguides formed therein, each said waveguide having a tapered end portion;

a plurality of rod feeds for collecting the signals, each said rod feed including an elongated frustum, a cylindrical middle section, and a compressed frustum, said elongated frustum of each said rod feed being inserted in one of said plurality of chokes, thereby being functionally coupled to said tapered end portion of each said waveguide for impedance-matching each said waveguide;

a dielectric cover disposed above said rod feeds for covering said rod feeds and for enhancing the gain of said rod feeds;

a horn feed;

a corrective lens disposed on said horn feed, said lens including a phase delay module coupled to the antenna feed for reshaping the wavefront of the signals collected by said antenna means prior to the signals entering the antenna feed, thereby smoothing the signals. said phase delay module having an ellipsoidal cylindrical center section and a first half-prolated ellipsoidal lobe and a second half-prolated ellipsoidal lobe; and a predetermined configuration of said rod feeds and said horn feed coupled to said antenna, wherein said predetermined configuration is determined by the relative positions of the signal sources.

15. The signal receiving apparatus of claim 14, wherein said compressed frustum comprises a first tapered section and a second tapered section having a larger angle of taper than the first tapered section.

16. The signal receiving apparatus of claim 14, wherein said compressed frustum has a rounded head.

17. The signal receiving apparatus of claim 14, wherein said elongated frustum has a rounded head.

18. The signal receiving apparatus of claim 14, wherein said compressed frustum is a cone.

19. The signal receiving apparatus of claim 14, wherein said elongated frustum is a cone.

20. A microwave corrective lens for use with an antenna feed for receiving microwaves having a wavefront, and an uneven constant phase plane, said corrective lens comprising:

a phase delay module coupled to the antenna feed for reshaping the wavefront of the microwave prior to the microwave entering the antenna feed, thereby smoothing the microwave, said phase delay module having an ellipsoidal cylindrical center section, a first haIf-prolated ellipsoidal lobe and a second half-prolated ellipsoidal lobe.

21. The microwave corrective lens of claim 20, wherein said microwave corrective lens is made of dielectric material.

22. The microwave corrective lens of claim 20, wherein the microwaves emanate from at least two satellite clusters.

* * * * *